US010566726B1

(12) United States Patent
Probert et al.

(10) Patent No.: US 10,566,726 B1
(45) Date of Patent: Feb. 18, 2020

(54) CONNECTOR WITH SLIDING TERMINAL POSITION ASSURANCE

(71) Applicant: Lear Corporation, Southfield, MI (US)

(72) Inventors: Deborah Probert, Farmington Hills, MI (US); Michael Glick, Winston-Salem, NC (US); David Menzies, Linden, MI (US); Rutunj Rai, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/204,761

(22) Filed: Nov. 29, 2018

(51) Int. Cl.
*H01R 13/426* (2006.01)

(52) U.S. Cl.
CPC ..... *H01R 13/426* (2013.01)

(58) Field of Classification Search
CPC ..... H01R 13/424; H01R 13/426
See application file for complete search history.

(56) References Cited

U.S. PATENT DOCUMENTS 5,672,073 A 9/1997 Matsumura et al.
6,068,507 A 5/2000 Popa
6,491,542 B1 12/2002 Zerebilov
6,547,584 B2 4/2003 Myer et al.
7,326,074 B1 2/2008 Lim et al.
2008/0318460 A1 12/2008 Hsieh et al.
2015/0372420 A1 12/2015 Kamei
2017/0207578 A1* 7/2017 Abraham ..... H01R 13/4361
2017/0250492 A1* 8/2017 Endo ..... H01R 13/426

FOREIGN PATENT DOCUMENTS

EP 1369964 A1 12/2003

* cited by examiner

*Primary Examiner* — Ross N Gushi
(74) *Attorney, Agent, or Firm* — MacMillan, Sobanski & Todd, LLC

(57) ABSTRACT

An electrical connector includes a connector mount. The connector mount has a cavity that is configured to receive a terminal. The electrical connector includes a terminal position assurance. The terminal position assurance is supported on the connector mount for movement between a pre-lock position and a locked position. The electrical connector includes a rocker attached to the connector mount. At least a portion of the rocker is configured move relative to the connector mount from a non-biased to a biased position. The rocker is configured to prevent the terminal position assurance from moving from the pre-lock position to the locked position when the rocker is in the non-biased position.

19 Claims, 9 Drawing Sheets

CONNECTOR WITH SLIDING TERMINAL POSITION ASSURANCE

BACKGROUND OF THE INVENTION

This invention relates to a terminal position assurance for an electrical connector. More specifically, this invention relates to a terminal position assurance that slides relative to the electrical connector.

In electrical systems, an electrical connector is adapted to act as a connector mount for a terminal assembly between a power or signal source and various relays, circuit breakers, and other electronic connections. In conventional systems, the electrical connector is often formed with an opening for receiving an electrical terminal.

In addition, the conventional electrical connector may include a terminal position assurance. The terminal position assurance is a mechanism that ensures the electrical terminal is properly positioned in the electrical connector and that helps retain the electrical terminal in the electrical connector. For example, U.S. Pat. No. 7,326,074 illustrates an electrical connector that includes a cavity for receiving an electrical terminal as well as a terminal position assurance device. It would be advantageous to have an alternative electrical connector with a terminal position assurance that is limited in movement before the terminal assembly is installed in the cavity and that also ensures that the terminal assembly is located in a fully inserted position within the cavity.

SUMMARY OF THE INVENTION

This invention relates to an electrical connector. The electrical connector includes a connector mount. The connector mount has a cavity that is configured to receive a terminal. The electrical connector includes a terminal position assurance. The terminal position assurance is supported on the connector mount for movement between a pre-lock position and a locked position. The electrical connector includes a rocker attached to the connector mount. At least a portion of the rocker is configured move relative to the connector mount from a non-biased to a biased position. The rocker is configured to prevent the terminal position assurance from moving from the pre-lock position to the locked position when the rocker is in the non-biased position.

In another embodiment, this invention relates to an electrical connector assembly. The electrical connector assembly includes a connector mount. The connector mount includes a cavity. The electrical connector assembly includes a terminal. The terminal is adapted to the located in a mounted position in the cavity. The electrical connector assembly includes a terminal position assurance. The terminal position assurance is supported on the connector mount and movable relative to the connector mount between a pre-lock position and a locked position. A rocker is connected to the connector mount proximate the cavity. The rocker is configured to limit movement of the terminal position assurance when the rocker is in a non-biased position.

Another embodiment of this invention relates to an electrical connector. The electrical connector includes a connector mount. The connector mount includes a cavity that is configured to receive a terminal. The connector mount also includes a terminal position assurance mount. The terminal position assurance mount includes a plurality of lock grooves. The electrical connector also includes a terminal position assurance. The terminal position assurance includes a TPA stop and a TPA handle that are connected by a TPA bridge. The terminal position assurance also includes a plurality of lock tabs. The terminal position assurance is adapted to be located in a pre-insertion position relative to the terminal position assurance mount wherein each of the lock tabs is located in one of the lock grooves. The terminal position assurance is adapted to be moved relative to the terminal position assurance mount from the pre-insertion position to a pre-lock position. When the terminal position assurance is in the pre-lock position, each of the lock tabs engages a lower surface of one of the lock grooves to prevent movement of the terminal position assurance toward the pre-insertion position.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
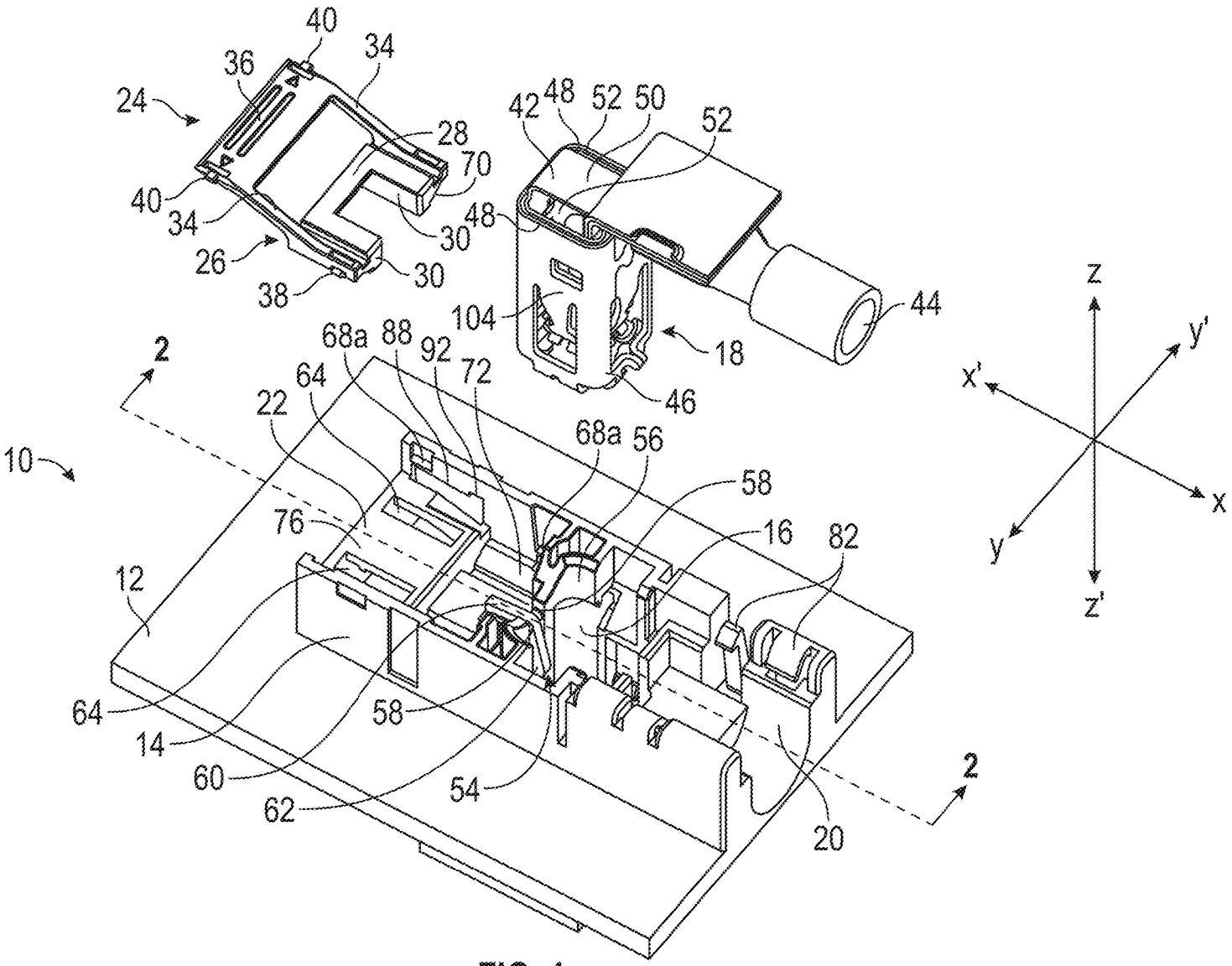
FIG. 1 is an exploded perspective view of an electrical connector including a connector mount, a terminal assembly, and a terminal position assurance.

Referring now to the drawings, there is illustrated in FIG. 1 a perspective view of an electrical connector, indicated generally at 10. The illustrated electrical connector 10 includes a base 12 and a connector mount 14 that is attached to the base 12. The illustrated base 12 is generally planar and extends primarily in directions x-x' and y-y', but the electrical connector 10 may have any desired shape. The connector mount 14 includes a cavity, indicated generally at 16, that is adapted to receive an electric terminal assembly 18, as will be described below. The illustrated cavity 16 extends through the base 12 in a direction z-z' that is generally perpendicular to directions x-x' and y-y'. However, the cavity 16 may have any desired relative orientation.

The illustrated connector mount 14 includes a terminal assembly mount 20 and a terminal position assurance mount 22. The terminal assembly mount 20 is configured to retain the electric terminal assembly 18 in the cavity 16. The terminal position assurance mount 22 is configured to retain a terminal position assurance (TPA), indicated generally at 24, on the connector mount 14 in a plurality of positions, as will be further described below.

Figure 1B:
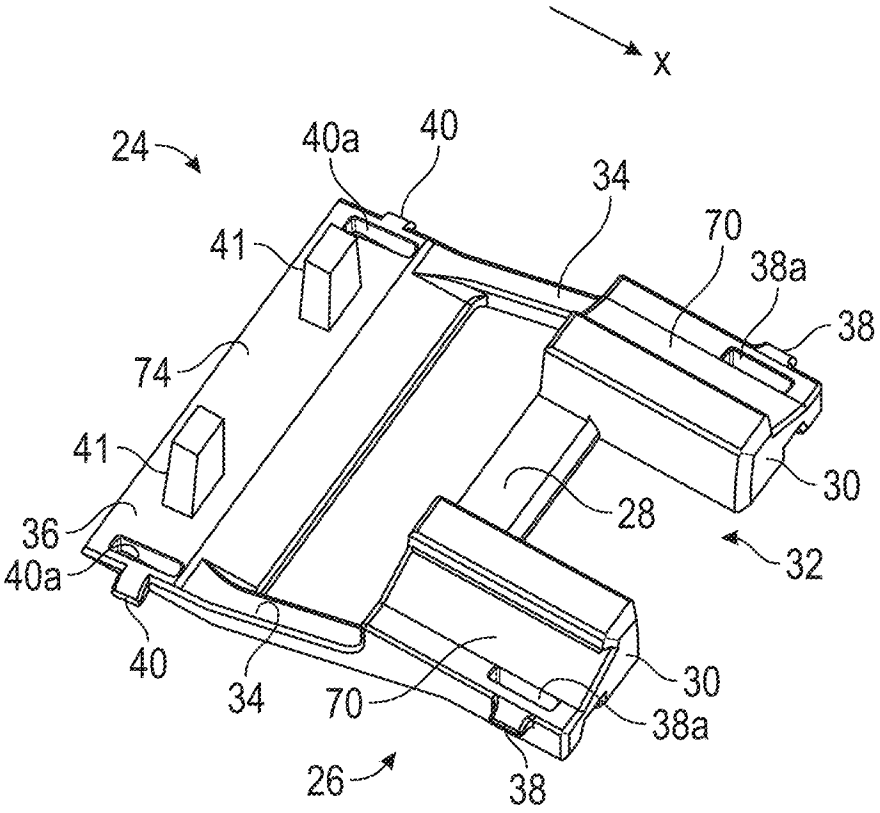
FIG. 1*b* is an enlarged perspective view of the terminal position assurance, taken from below.
Figure 1A:
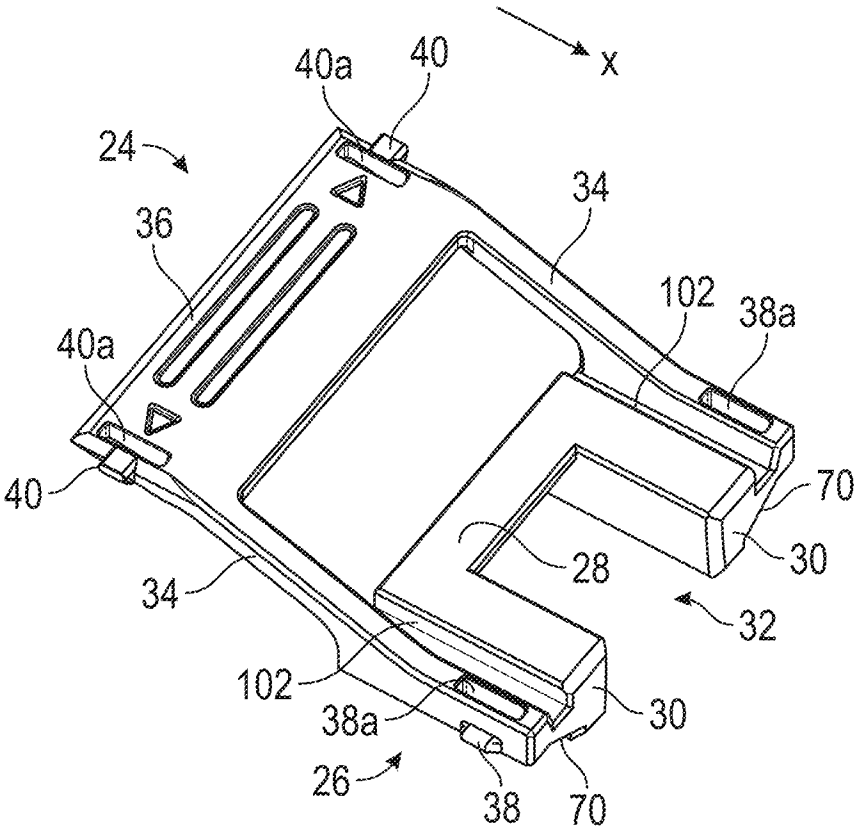
FIG. 1*a* is an enlarged perspective view of the terminal position assurance, taken from above.

Referring to FIG. 1*a*, an enlarged perspective view of the TPA 24 is shown from above, while in FIG. 1*b*, a perspective view of the TPA 24 is shown from below. The illustrated TPA 24 is molded from plastic, but may be made of any desired material and by any desired process. The TPA 24 includes a TPA stop, indicated generally at 26. The TPA stop 26 includes a TPA base 28. The illustrated TPA base 28 is a generally flat and rectangular, but the TPA base 28 may have any desired shape. The TPA stop 26 includes two block members 30 that extend from the TPA base 28. The illustrated block members 30 extend from the TPA base 28 in a forward direction x and are generally parallel to each other, but may have any desired orientations. The block members 30 are separated from each other by a TPA space, indicated generally at 32. Although the illustrated TPA 24 includes two block members 30, the TPA 24 may include any desired number of block members 30.

The TPA 24 includes TPA bridges 34 that extend generally in a rearward direction x' from the TPA stop 26. The illustrated TPA 24 includes two TPA bridges 34, but may include any desired number of TPA bridges 34. Each of the illustrated TPA bridges 34 is connected to one of the block members 30, but the TPA bridges 34 may be connected to any desired part of the TPA stop 26. The TPA bridges 34 are connected to each other by a TPA handle 36 that extends generally parallel to the TPA base 28. The TPA bridges 34 are relatively flexible and allow for relative movement between the TPA stop 26 and the TPA handle 36, as will be described below.

The TPA 24 includes forward lock tabs 38 and rear lock tabs 40 that serve to retain the TPA 24 in position relative to the terminal position assurance mount 22 and to guide movement of the TPA 24 relative to the terminal position assurance mount 22, as will be described below. The illustrated TPA 24 includes two forward lock tabs 38 and two rear lock tabs 40, but may include any desired number of lock tabs 38 and 40. The illustrated forward lock tabs 38 are located on the TPA stop 26, and the illustrated rear lock tabs 40 are located on the TPA handle 36, but may be located on any desired part of the TPA 24.

The illustrated TPA 24 includes optional guide pegs 41 that extend from the TPA handle 36. The illustrated TPA 24 includes two guide pegs 41, but may include any desired number of guide pegs 41. The illustrated guide pegs 41 extend from the TPA handle 36 in a z'-direction, but may have any desired orientation. The illustrated guide pegs 41 have generally rectangular cross-sectional shapes perpendicular to the z'-direction, but may have any desired shapes.

Referring back to FIG. 1, the electric terminal assembly 18 includes an electric terminal 42 that is connected to a conductive member 44. The illustrated electric terminal 42 is a box-type female terminal, but may be any desired type of electric terminal. The electric terminal 42 is adapted to mate with a corresponding male electric terminal (not shown) to create an electrical connection to the conductive member 44. The illustrated electric terminal assembly 18 includes a box spring 46 located around the electric terminal 42. However, the electric terminal assembly 18 may have any desired configuration.

The electric terminal assembly 18 includes a terminal shoulder 48 and a terminal back 50 that define a terminal stop space 52. In the illustrated embodiment, the terminal shoulder 48 is defined in part by the box spring 46, and the terminal back 50 is defined by part of the electric terminal 42. However, the terminal shoulder 48 and the terminal back 50 may be defined by any desired parts of the electric terminal assembly 18. The illustrated electric terminal assembly 18 includes two terminal stop spaces 52, but may include any desired number of terminal stop spaces 52.

Figure 2:
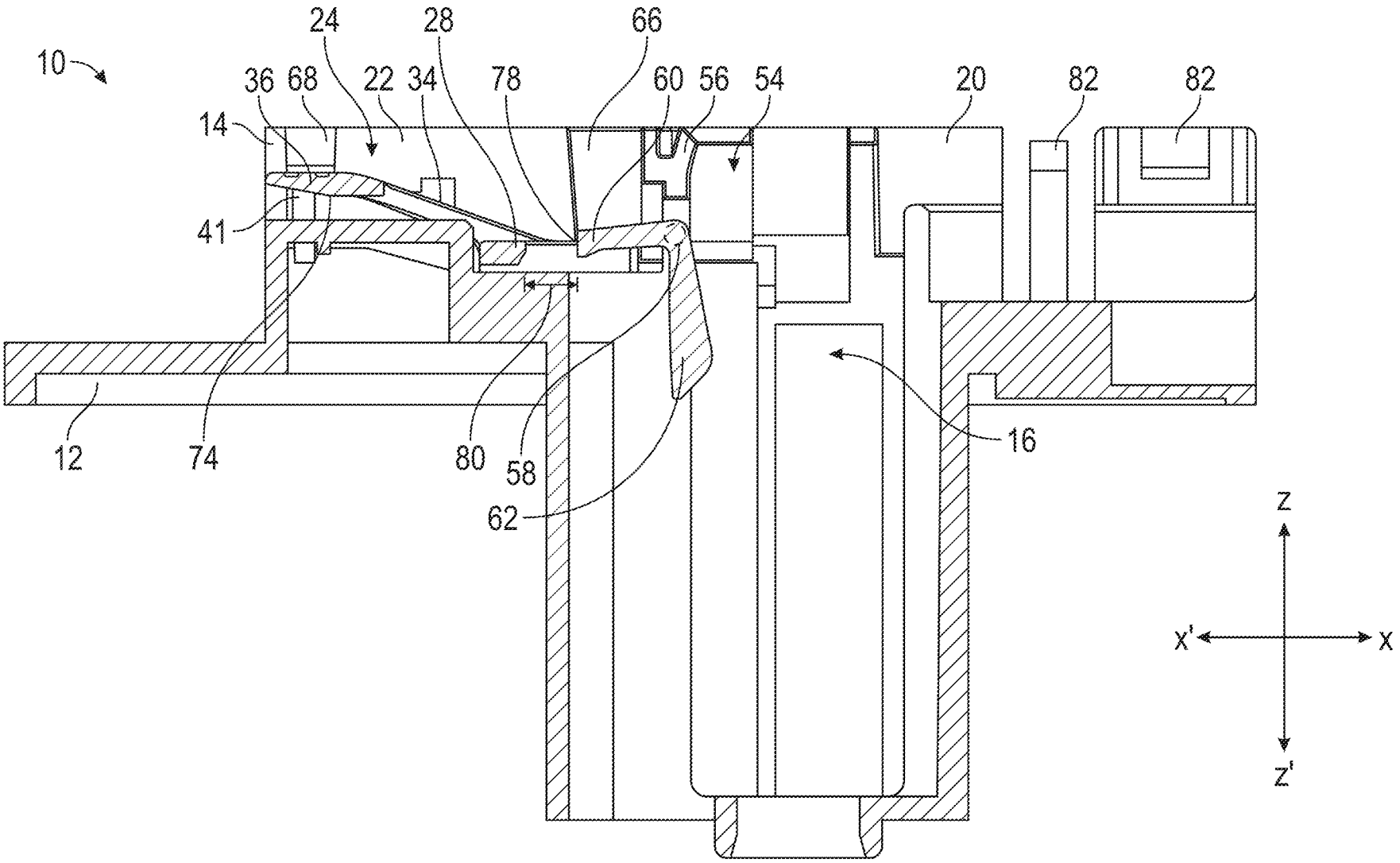
FIG. 2 is a cross-sectional view through the electrical connector taken along the line 2-2 of FIG. 1, wherein the terminal position assurance is shown in a pre-lock position relative to the connector mount, and a rocker on the connector mount is shown in a non-biased position.

Referring now to FIG. 2, there is illustrated a cross-sectional view of the electrical connector 10 taken along the line 2-2 of FIG. 1 wherein additionally, the TPA 24 is shown in a pre-lock position relative to the terminal position assurance mount 22. The electrical connector 10 includes a rocker, indicated generally at 54. The rocker 54 is attached to the connector mount 14 for relative movement between a non-biased position, shown in FIGS. 1 and 2, and a biased position that will be described below. The illustrated rocker 54 is attached to a rocker bridge 56 that is located between the terminal assembly mount 20 and the terminal position assurance mount 22. The illustrated rocker 54 is molded as part of the rocker bridge 56, but may be a separate piece if desired.

The rocker 54 is attached to the rocker bridge 56 by a rocker pivot 58, which allows the rocker 54 to rotate relative to the rocker bridge 56. In the illustrated embodiment, as best shown in FIG. 1, the rocker pivot 58 includes two relatively narrow, molded connections between the rocker 54 and the rocker bridge 56. However, any desired type of rotational connection may be used. Referring back to FIG. 2, the rocker 54 includes a stop arm 60 that extends from the rocker pivot 58 toward the terminal position assurance mount 22 and a cavity arm 62 that extends from the rocker pivot 58 at least partially into the cavity 16. The cavity arm 62 extends generally in the z-z' direction from the rocker pivot 58.

As previously described, the TPA 24 is shown separate from the electrical connector 10 in FIG. 1 and in a pre-lock position in FIG. 2. To put the TPA 24 into the pre-lock position relative to the connector mount 14, the TPA 24 is initially positioned in a pre-insertion position adjacent the terminal position assurance mount 22 with each of the guide pegs 41 located in respective guide slots 64 on the terminal position assurance mount 22. The guide slots 64 are elongated channels that extend in x-direction. The TPA 24 is further positioned with the forward lock tabs 38 in forward lock grooves 66 (shown in FIG. 3) on the connector mount 14 and with the rear lock tabs 40 in rear lock grooves 68 on the connector mount 14. The TPA 24 is then moved in the z' direction relative to the connector mount 14. Each of the lock grooves 66 and 68 includes a respective sloped groove end 66*a* and 68*a* (two of these are visible on FIG. 3).

When the lock tabs 38 and 40 engage the sloped groove ends 66*a* and 68*a*, they are biased toward the TPA stop 26 and the TPA handle 36, respectively. As shown in FIG. 1*a*, the TPA 24 includes a forward aperture 38*a* adjacent to each of the forward lock tabs 38 and a rear aperture 40*a* adjacent to each of the rear lock tabs 40. The apertures 38*a* and 40*a* allow the lock tabs 38 and 40 to deflect inwardly. Thus, the TPA 24 is adapted to be moved so that the lock tabs 38 and 40 can move past the respective sloped groove ends 66*a* and 68*a*. The lock tabs 38 and 40 then rebound, and the TPA 24 is located in the pre-lock position relative to the connector mount 14. The lock tabs 38 and 40 engage respective lower surfaces 66*b* and 68*b* (two of these are visible on FIG. 4*b*) of the lock grooves 66 and 68 to prevent the TPA 24 from being moved in the z-direction relative to the connector mount 14 and out of the pre-lock position.

As shown in FIGS. 1 and 1*b*, the TPA 24 includes TPA guide surfaces 70. The illustrated TPA guide surfaces 70 are located on the TPA stop 26, specifically on the block members 30. However, the TPA guide surfaces 70 may be located on any desired part of the TPA 24. As shown in FIG. 1, the connector mount 14 includes mount guide surfaces 72. The illustrated mount guide surfaces 72 are located in the terminal position assurance mount 22, and the TPA guide surfaces 70 are engaged with the mount guide surfaces 72 when the TPA 24 is located in the pre-lock position. The illustrated connector mount 14 includes the mount guide surfaces 72 to engage the TPA guide surfaces 70 on both block members 30, although not all the mount guide surfaces 72 are visible in FIG. 1.

When the illustrated TPA 24 is moved to the pre-lock position, the TPA handle 36 is moved in the z'-direction relative to the connector mount 14. Additionally, the TPA handle 36 is moved in the z'-direction relative to the TPA stop 26. The TPA guide surfaces 70 engage the mount guide surfaces 72 to prevent further movement of the TPA stop 26 in the z'-direction, while the TPA handle 36 is adapted to be moved further in the z'-direction. As previously described, the TPA bridges 34 are relatively flexible and allow for relative movement between the TPA stop 26 and the TPA handle 36. Thus, the TPA bridges 34 bend, and the TPA handle 36 rotates relative to the TPA stop 26 into the pre-lock position.

The guide pegs 41 extend from a stop surface 74 of the TPA handle 36, which is adapted to engage a mount stop surface 76 on the terminal position assurance mount 22 to limit rotation of the TPA handle 36 relative to the TPA stop 26. This limits the maximum amount of strain that can be applied to the TPA bridges 34. Thus, an operator may insert the TPA 24 into the terminal position assurance mount 22 and press down on the TPA handle 36 in order to move the TPA 24 to the pre-lock position without damaging the TPA bridges 34. When the operator releases the TPA handle 36, the TPA bridges 34 will rebound, and the TPA handle 36 will move in the z-direction relative to the connector mount 14. In the illustrated embodiment, the TPA bridges 34 do not rebound to a neutral position because the rear lock tabs 40 engage the lower surfaces 68*b* of the lock groove 68 and restrain movement of the TPA handle 36. Thus, the TPA handle 36 is pre-stressed in the terminal position assurance mount 22 when the TPA 24 is located in the pre-lock position.

When the TPA 24 is located in the pre-lock position, it is movable relative to the connector mount 14 in the x-direction toward the cavity 16, as will be described below. As best shown in FIG. 2, when the TPA 24 is located in the pre-lock position and the rocker 54 is located in the non-biased position, the rocker 54 functions as a stop that limits movement of the TPA 24 in the x-direction relative to the connector mount 14. When the TPA 24 is located in the pre-lock position and the rocker 54 is located in the non-biased position, the stop arm 60 is located at least partially in the TPA space 32. Additionally, the stop arm 60 is located in the x-direction of the TPA base 28. Thus, the TPA base 28 is adapted to engage a stop end 78 of the stop arm 60 when the TPA 24 is moved in the x-direction from the pre-lock position relative to the connector mount 14. In the illustrated embodiment, the TPA 24 is adapted to move an initial distance 80 from the pre-lock position before the TPA base 28 engages the stop arm 60. However, the TPA base 28 and the stop arm 60 may have any desired initial distance therebetween. In the illustrated embodiment, the stop arm 60 of the rocker 54 is adapted to engage the TPA base 28. However, the rocker 54 may be adapted to engage any desired part of the TPA 24.

Figure 3:
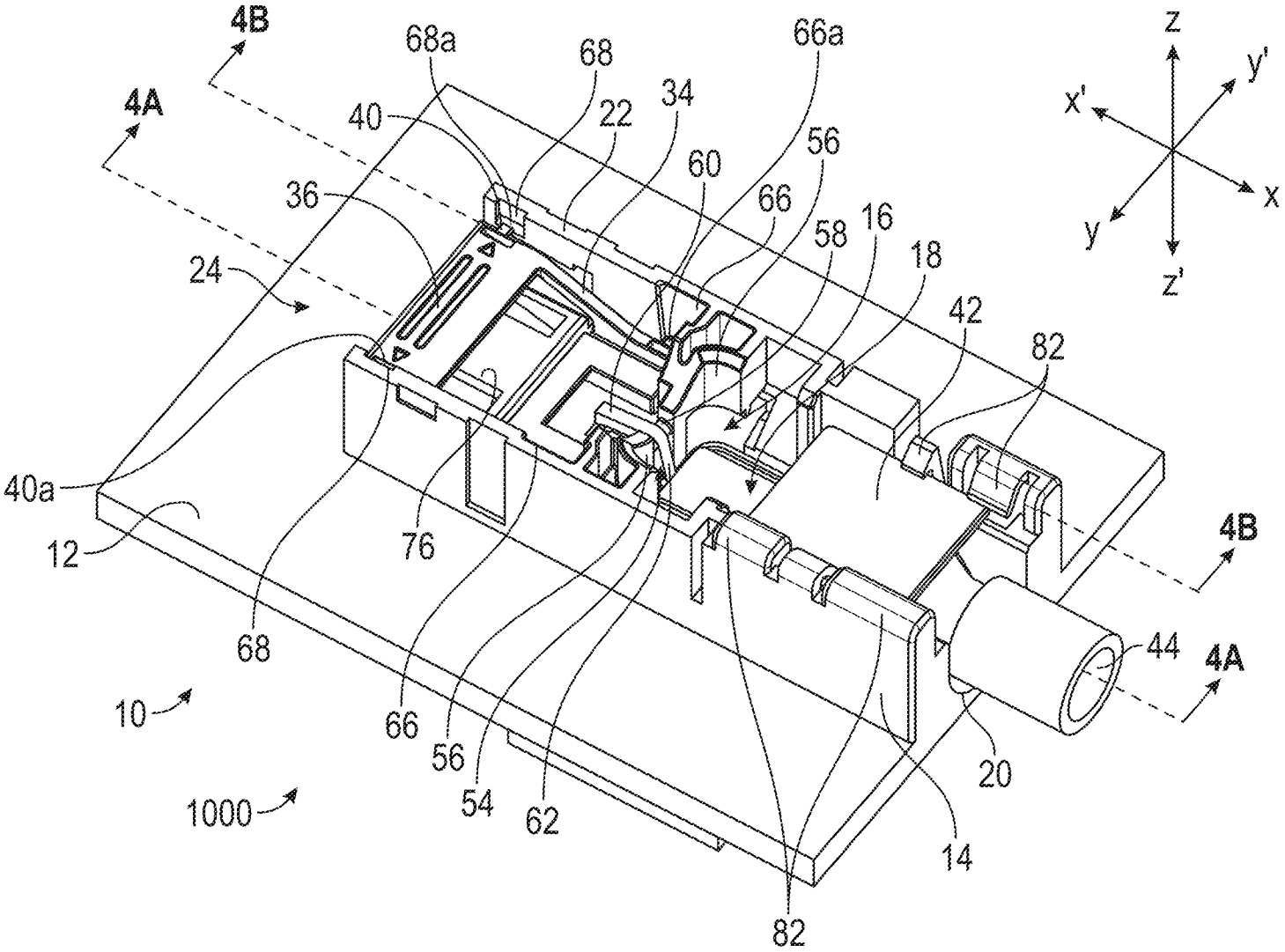
FIG. 3 is a perspective view similar to FIG. 1, wherein the terminal assembly is shown inserted into a cavity on the connector, and the terminal position assurance is shown in the pre-lock position.

Referring now to FIG. 3, there is illustrated a view similar to FIG. 1, with the TPA 24 shown in the pre-lock position, and the electric terminal assembly 18 shown in a mounted position relative to the connector mount 14. The electrical connector 10, TPA 24, and electric terminal assembly 18 assembled together form an electrical connector assembly, indicated generally at 1000. To put the electric terminal assembly 18 into the mounted position, the electric terminal assembly 18 is moved in the z'-direction relative to the terminal assembly mount 20 so that the electric terminal 42 and the box spring 46 enter the cavity 16. Resilient hooks 82 on the terminal assembly mount 20 engage the electric terminal assembly 18 and retain it in the mounted position relative to the terminal assembly mount 20. However, any desired retainer mechanism may be used to hold the electric terminal assembly 18 in the mounted position.

As previously described, the cavity arm 62 on the rocker 54 extends at least partially into the cavity 16. When the electric terminal assembly 18 is located in the mounted position, it engages the cavity arm 62 and moves the rocker 54 relative to the connector mount 14 to the biased position. In the illustrated embodiment, the box spring 46 engages the cavity arm 62 when the electric terminal assembly 18 is located in the mounted position. However, any desired part of the electric terminal assembly 18 may engage the cavity arm 62.

Figure 4A:
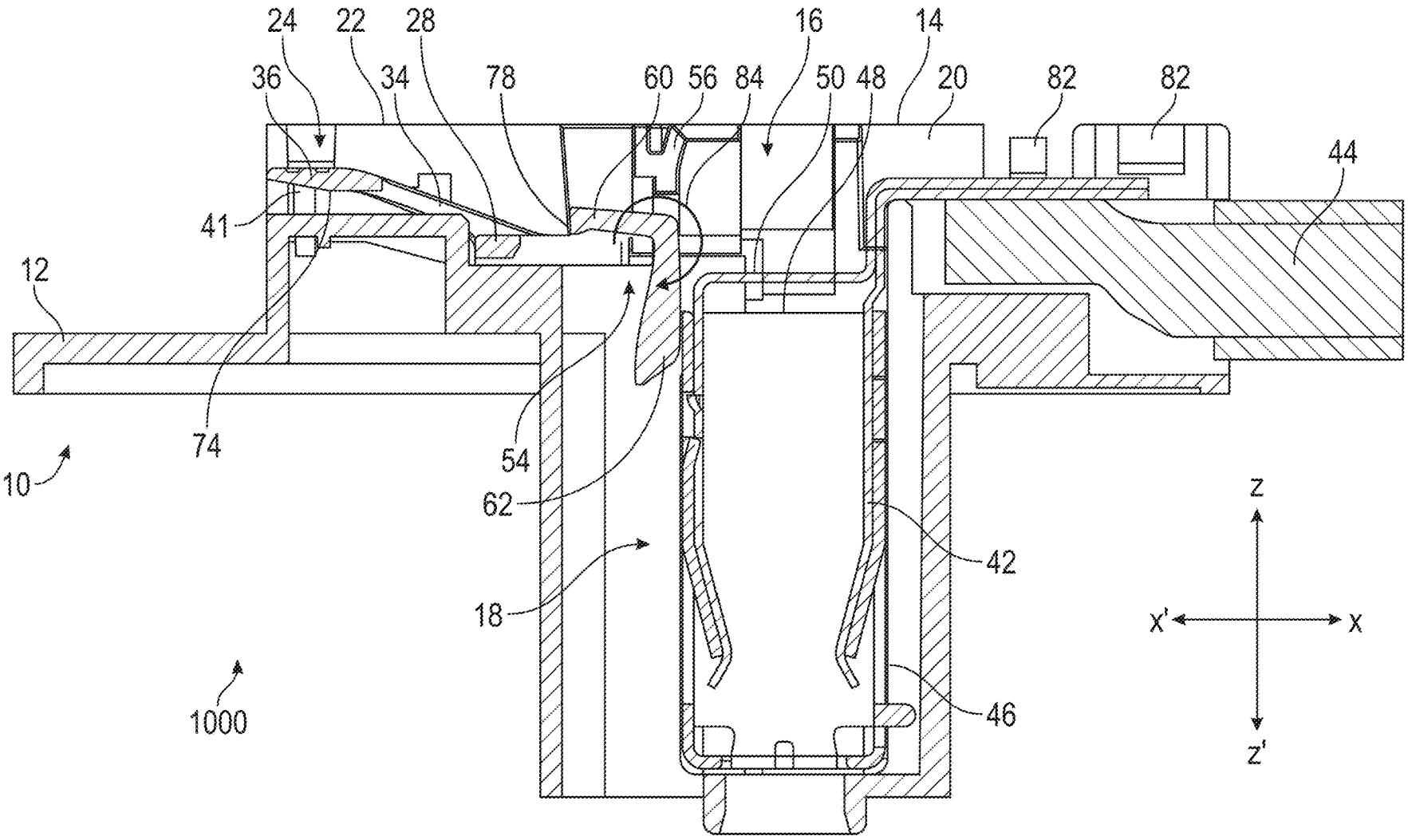
FIG. 4*a* is a cross-sectional view taken along the line 4*a*-4*a* of FIG. 3, showing the terminal position assurance in the pre-lock position and the rocker in a biased position.

Referring to FIG. 4*a*, a cross-sectional view taken along the line 4*a*-4*a* of FIG. 3 is illustrated. This cross-sectional view is similar to the view illustrated in FIG. 2. As previously described, the rocker 54 is movable relative to the rocker bridge 56 at the rocker pivot 58. As shown, when the electric terminal assembly 18 is located in the mounted position, the cavity arm 62 is pushed in the x'-direction out of the cavity 16. This causes the rocker 54 to rotate relative to the connector mount 14 in a bias direction 84 (clockwise as viewed in FIG. 4*a*). The rotation of the rocker 54 causes the stop arm 60 to move to a bias position, also shown in FIG. 4*a*. In the illustrated embodiment, the stop end 78 of the stop arm 60 moves in the z-direction relative to the connector mount 14 when the rocker 54 moves to the biased position. However, the stop arm 60 may move in any desired relative direction.

Figure 5A:
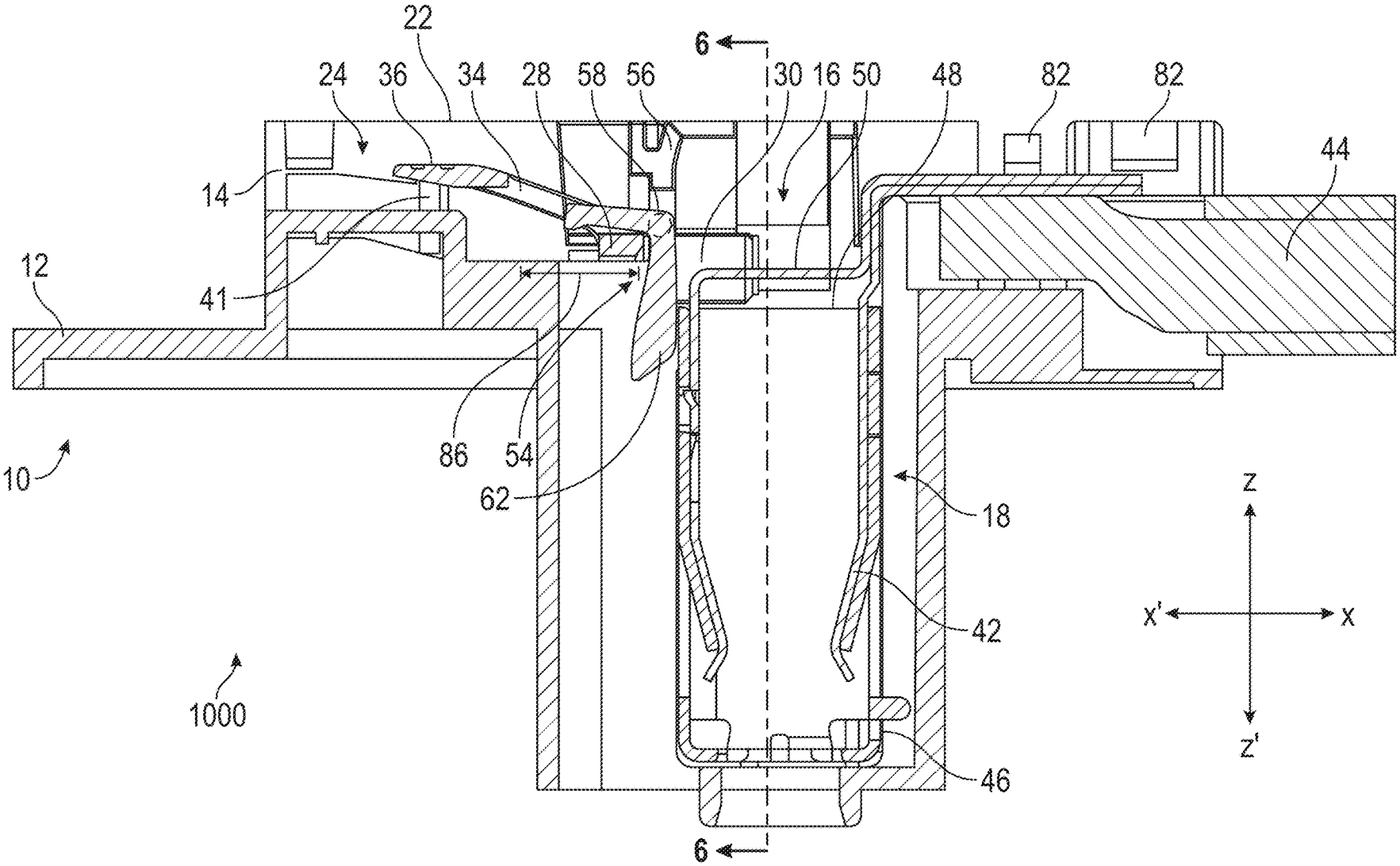
FIG. 5*a* is a cross sectional view similar to FIG. 4*a*, showing the terminal position assurance located in a locked position.

When the rocker 54 is located in the biased position, the stop arm 60 is not located in the x-direction of the TPA base 28. Thus, the TPA 24 can be moved in the x-direction relative to the connector mount 14, and the TPA base 28 will not engage the stop end 78 of the stop arm 60. When the rocker 54 is located in the biased position, the TPA 24 is adapted to be moved an assurance distance 86 in the x-direction from the pre-lock position relative to the connector mount 14. The assurance distance 86, shown on FIG. 5*a*, is greater than the initial distance 80, which allows the TPA 24 to extend into the cavity 16, as described below.

Figure 4B:
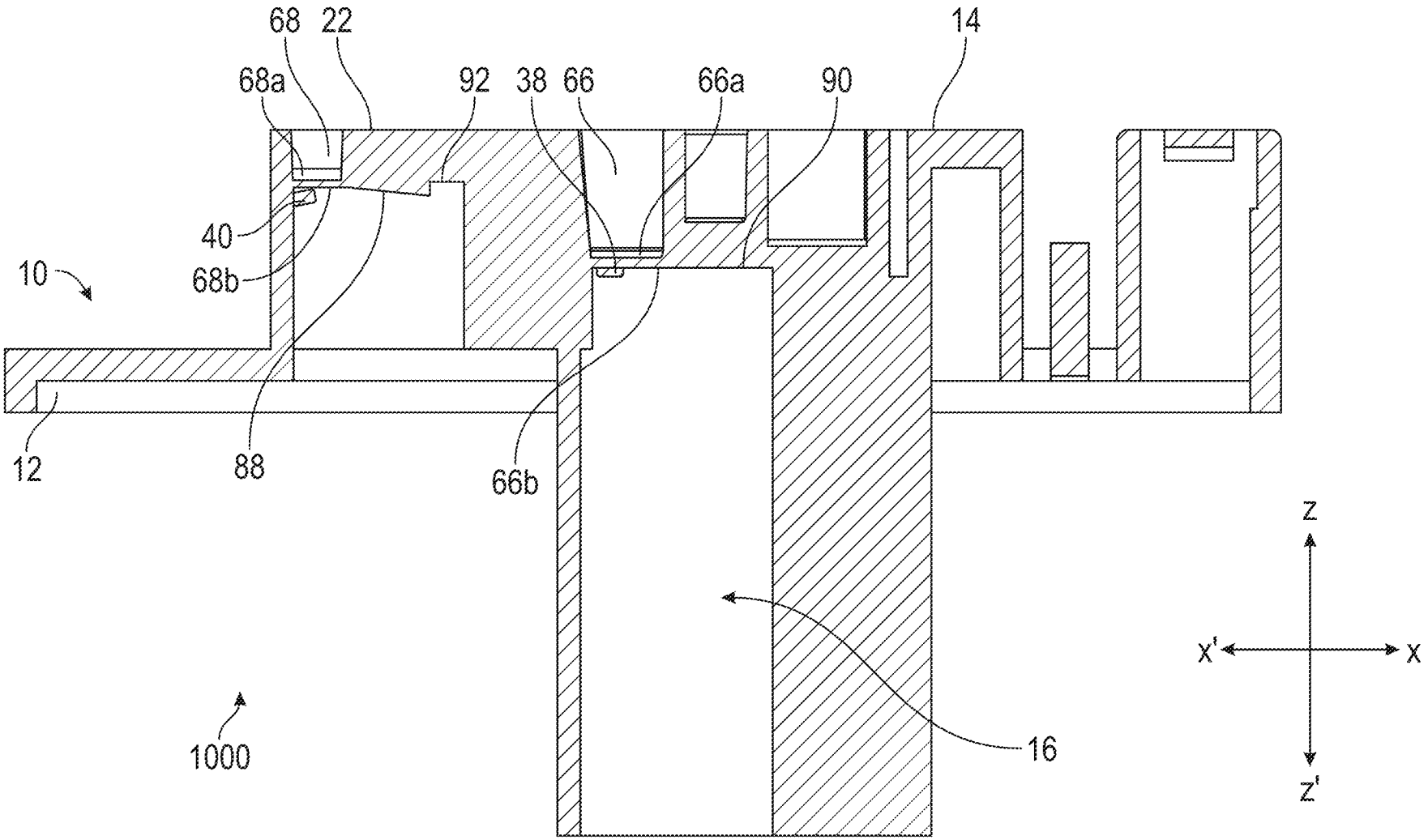
FIG. 4*b* is a cross-sectional view taken along the line 4*b*-4*b* of FIG. 3, showing the location of TPA tabs when the terminal position assurance is located in the pre-lock position.

Referring to FIG. 4*b*, there is illustrated a cross-sectional view taken along the line 4*b*-4*b* of FIG. 2. This view is taken through one of the forward lock tabs 38 and one of the rear lock tabs 40 on the TPA 24. As previously described, when the TPA 24 is located in the pre-lock position, the rear lock tab 40 is biased against a lower surface 68*b* of the rear lock groove 68. The lower surface 68*b* is part of a rear guide surface 88 that extends generally toward the cavity 16 in the x-direction. The illustrated rear guide surface 88 is sloped relative to the x-direction and slopes in the z-direction.

However, the rear guide surface 88 may have any desired orientation. The forward lock tab 38 is located adjacent to the lower surface 66*b* of the forward lock groove 66. The lower surface 66*b* is part of a forward guide surface 90 that extends in the x-direction. However, the forward guide surface 90 may have any desired orientation.

Figure 5B:
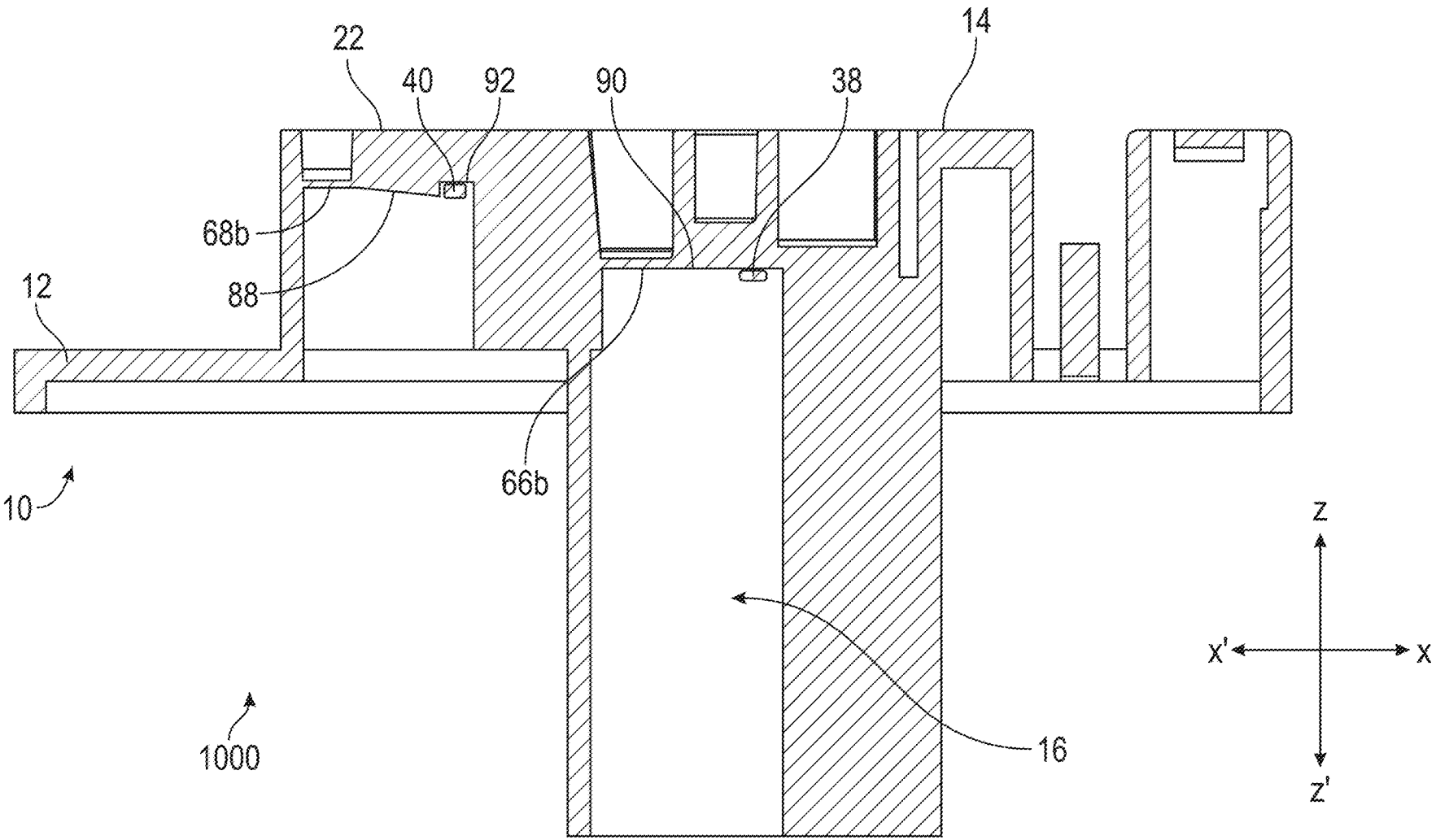
FIG. 5*b* is a cross-sectional view similar to FIG. 4*b*, showing the location of the TPA tabs when the terminal position assurance is located in the locked position.

As previously described, when the TPA 24 is located in the pre-lock position, it is adapted to be moved relative to the connector mount 14 in the x-direction toward the cavity 16. Referring to FIG. 5*b*, there is illustrated a cross-sectional view similar to FIG. 4*b*, showing the TPA 24 moved to the locked position. When the TPA 24 is moved to the locked position, the TPA stop 26 is moved in the x-direction toward the cavity 16. As shown, the forward lock tab 38 moves in the x-direction and remains adjacent to the forward guide surface 90. The rear lock tab 40 is biased against the rear guide surface 88. As the TPA 24 is moved in the x-direction, the rear lock tab 40 is biased in the z'-direction. This causes the TPA handle 36 to rotate relative to the TPA stop 26 and the TPA bridges 34 to bend, which increases the stress on the TPA bridges 34.

The connector mount 14 includes lock pockets 92 located in the x-direction of the rear guide surface 88. The lock pocket 92 is also located in the z-direction of the rear guide surface 88. When the TPA 24 has been moved in the x-direction to the locked position, the rear lock tab 40 is located in the lock pocket 92. The rear lock tab 40 is able to be moved in the z-direction, and the TPA bridges 34 will rebound to move the TPA handle 36 in the z-direction relative to the TPA stop 26. This causes the rear lock tab 40 to move into the lock pocket 92.

The rear lock tab 40 engages a wall of the lock pocket 92 to prevent further movement of the TPA 24 in the x-direction from the locked position. Also, when the TPA 24 is located in the locked position, a force applied to move the TPA 24 in the x'-direction (back toward the pre-lock position), will be resisted by the rear lock tab 40 engaging the wall of the lock pocket 92.

Although only one rear guide surface 88, one forward guide surface 90, and one lock pocket 92 are shown in FIGS. 4*b* and 5*b*, it should be appreciated that the illustrated electric connector 10 includes a second set of similar features that cooperate similarly with the forward lock tab 38 and the rear lock tab 40 on the other side of the TPA 24.

Referring now to FIG. 5*a*, there is illustrated a cross-sectional view similar to FIG. 4*a*, showing the electric connector 10 when the TPA 24 is located in the locked position. The TPA 24 has been moved the assurance distance 86 in the x-direction from the pre-lock position relative to the connector mount 14, and the block members 30 are located at least partially in the cavity 16. The guide pegs 41 have moved in the guide slots 64 in x-direction.

Figure 6:
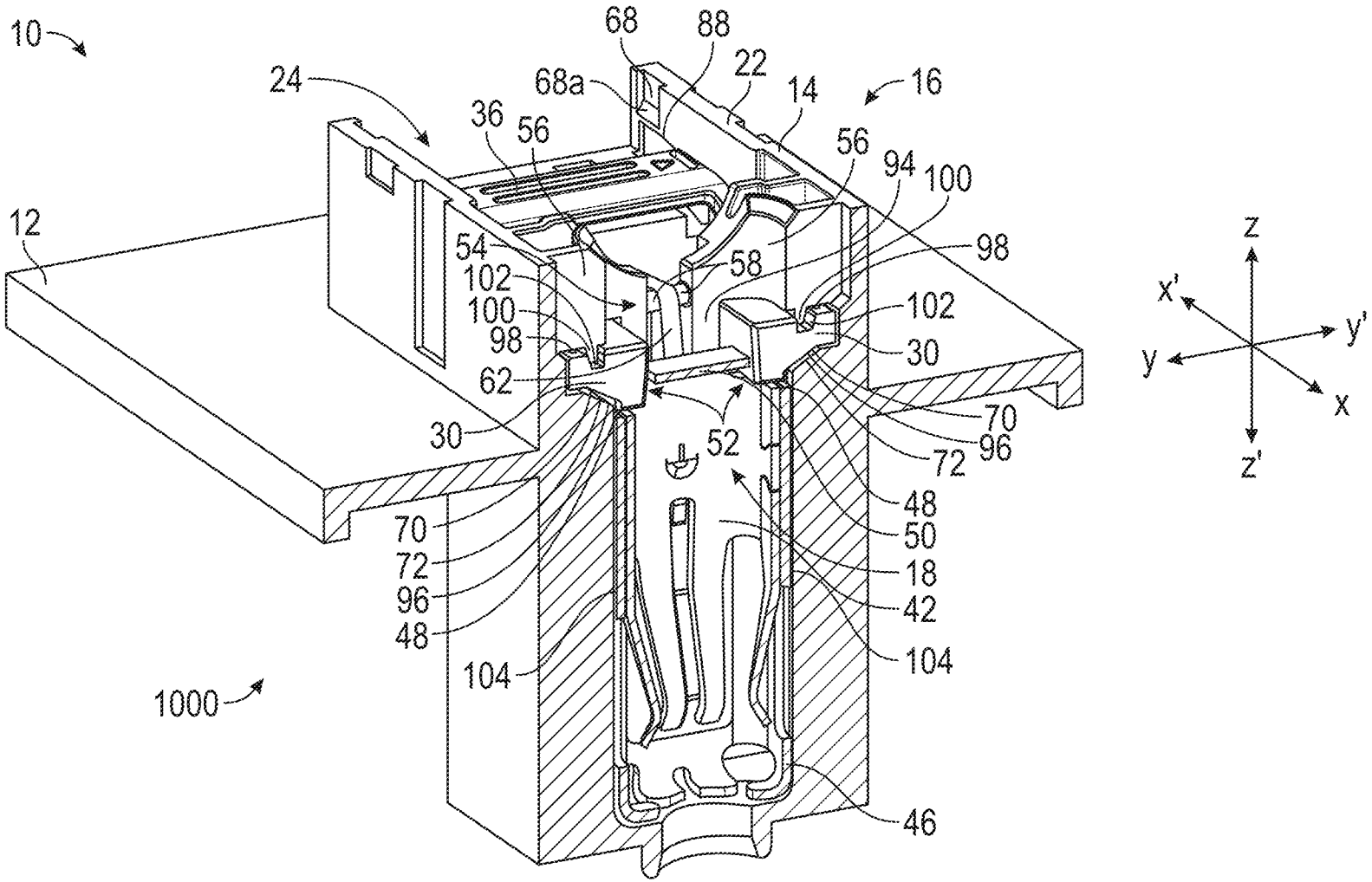
FIG. 6 is a perspective, cut-away view of FIG. 5*a*, taken along the line 6-6.

FIG. 6 is a perspective, cut-away view of the electrical connector 10 taken along the line 6-6 of FIG. 5*a*. As previously described, the rocker bridge 56 is located between the terminal assembly mount 20 and the terminal position assurance mount 22. The rocker bridge 56 includes a cross wall 94 that is located between the TPA base 28 and the cavity 16. The rocker bridge 56 defines block holes 96 that extend from the terminal assembly mount 20 to the terminal position assurance mount 22. The illustrated rocker bridge 56 defines two block holes 96, but may include any desired number of block holes 96. Each of the block members 30 on the TPA 24 extends through one of the block holes 96 when the TPA 24 is located in the locked position.

As best shown in FIG. 6, the mount guide surfaces 72 are located on one side of the block holes 96. The rocker bridge 56 extends over the block members 30 in the z-direction, and the connector mount 14 includes a second mount guide surface 98 that is located on the opposite side of the block hole 96 from the mount guide surface 72. In the illustrated embodiment, the second mount guide surface 98 includes an extended ridge 100 that cooperates with a channel 102 on the TPA stop 26 in order to guide the movement of the TPA 24 in the x-direction between the pre-lock position and the locked position.

When the electric terminal assembly 18 is located in the mounted position and the TPA 24 is located in the locked position, the block members 30 extend into the cavity 16 such that each block member 30 is located partially within one of the terminal stop spaces 52 on the electric terminal assembly 18. The block member 30 is located in the z-direction of a portion of the electric terminal assembly 18. Additionally, a portion of the terminal back 50 is located within the TPA space 32 between the two block members 30. The TPA 24 retains the electric terminal assembly 18 in the cavity 16 when the TPA 24 is located in the locked position. If a force is applied to the electric terminal assembly 18 to move it out of the cavity 16 in the z-direction, the electric terminal assembly 18 will engage the block members 30. The force is transferred to the block members 30, which will engage the rocker bridge 56 to prevent movement of the TPA stop 26 and the electric terminal assembly 18 in the z-direction relative to the connector mount 14.

The electric terminal assembly 18 is adapted to be removed from the connector mount 14 by reversing the previously-described process in order to move the TPA 24 from the locked position to the pre-lock position. Referring back to FIG. 5*a*, the operator may apply a force to the TPA handle 36 in the z'-direction. Referring to FIG. 5*b*, this will cause the rear lock tabs 40 to move in the z'-direction out of the lock pockets 92. The TPA 24 is then adapted to move in the x'-direction relative to the connector mount 14 to the pre-lock position illustrated in FIG. 4*b*. Referring back to FIG. 4*a*, with the TPA 24 in the pre-lock position, the block members 30 are not located in the terminal stop spaces 52 on the electric terminal assembly 18. Thus, the electric terminal assembly 18 may be removed from the cavity 16 without interference by the TPA 24. When the electric terminal assembly 18 is removed from the cavity 16, the rocker 54 will return to the non-biased position shown in FIG. 2.

As previously described, the TPA 24 can only be moved the initial distance 80 from the pre-lock position when the rocker 54 is located in the non-biased position. In the event that the electric terminal assembly 18 is inserted into the cavity 16 but is not fully located in the mounted position such that the electric terminal assembly 18 is located in a partial inserted position, the electric terminal assembly 18 will engage the rocker 54 and move it to the biased position. However, in the illustrated embodiment, the TPA 24 will still be blocked from moving to the locked position. Referring back to FIG. 1, the electric terminal assembly 18 includes outer walls 104 that are wider than the terminal back 50. If the electric terminal assembly 18 is only partially inserted into the cavity 16, the block members 30 will engage the outer walls 104 of the electric terminal assembly 18 to prevent the TPA 24 from moving to the locked position.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An assembly comprising:

a connector mount including a cavity configured to receive a terminal and a rocker attached to the connector mount; and a terminal position assurance supported on the connector mount for movement between a pre-lock position and a locked position; wherein at least a portion of the rocker is configured move relative to the connector mount from a non-biased to a biased position;

the rocker is configured to prevent the terminal position assurance from moving from the pre-lock position to the locked position when the rocker is in the non-biased position; and the terminal position assurance is configured to retain the terminal in the cavity when the terminal position assurance is in the locked position.

2. The assembly according to claim 1, wherein the rocker is configured to allow the terminal position assurance to move from the pre-lock position to the locked position when the terminal is in the cavity.

3. The assembly according to claim 1, wherein the rocker is adapted to rotatably move relative to the connector mount.

4. The assembly according to claim 1, wherein the rocker includes a stop arm and a cavity arm.

5. The assembly according to claim 4, wherein the cavity arm is configured to engage the terminal in the cavity to move the rocker from the non-biased to the biased position.

6. The assembly according to claim 5, wherein when the rocker is located in the biased position, movement of the terminal position assurance from the pre-lock position to the locked position is allowed.

7. An electrical connector assembly comprising:

a connector mount including a cavity and a rocker connected to the connector mount proximate the cavity;

a terminal located in a mounted position in the cavity; and a terminal position assurance supported on the connector mount and movable relative to the connector mount between a pre-lock position and a locked position; wherein the rocker is configured to limit movement of the terminal position assurance when the rocker is in a non-biased position; and the terminal position assurance limits movement of the terminal out of the mounted position when the terminal position assurance is in the locked position.

8. The electrical connector assembly according to claim 7, wherein when the terminal is in the mounted position, the rocker is moved to a biased position and allows the terminal position assurance to move from the pre-lock position to the locked position.

9. The electrical connector assembly according to claim 7, wherein the rocker is adapted to rotate relative to the connector mount.

10. The electrical connector assembly according to claim 7, wherein the rocker includes a stop arm that extends toward the terminal position assurance and a cavity arm that extends into the cavity.

11. The electrical connector assembly according to claim 7, wherein the terminal position assurance further includes at least one lock tab that is received by the connector mount.

12. The electrical connector assembly according to claim 11, wherein the at least one lock tab is configured engage at least a portion of the connector mount to restrict movement of the terminal position assurance between the pre-lock position and locked position.

13. An assembly comprising:

a connector mount including a cavity configured to receive a terminal and a terminal position assurance mount, the terminal position assurance mount including a plurality of lock grooves; and a terminal position assurance including a TPA stop and a TPA handle that are connected by a TPA bridge, the terminal position assurance including a plurality of lock tabs; wherein the terminal position assurance is adapted to be located in a pre-insertion position relative to the terminal position assurance mount wherein each of the lock tabs is located in one of the lock grooves;

the terminal position assurance is adapted to be moved relative to the terminal position assurance mount from the pre-insertion position to a pre-lock position where each of the lock tabs engages a lower surface of one of the lock grooves to prevent movement of the terminal position assurance toward the pre-insertion position; and the TPA handle is movable relative to the TPA stop such that the TPA handle can be moved relative to the TPA stop when the terminal position assurance is in the pre-lock position so that the TPA bridge is stressed.

14. The assembly of claim 13, wherein the connector mount includes a rocker bridge located between the terminal position assurance mount and the cavity, and wherein the rocker bridge defines a block hole that extends between the terminal position assurance mount and the cavity.

15. The assembly of claim 14, wherein the terminal position assurance is adapted to be moved relative to the terminal position assurance mount from the pre-lock position in a direction toward the cavity such that a block member on the TPA stop enters the block hole; and wherein the rocker bridge includes a guide surface that cooperates with the TPA stop to guide the movement of the terminal position assurance in the direction.

16. The assembly of claim 15, wherein the terminal position assurance is adapted to be moved relative to the terminal position assurance mount from the pre-lock position in the direction to a locked position wherein the block member is located at least partially in the cavity; and wherein the plurality of lock tabs includes rear lock tabs attached to the TPA handle that engage respective rear guide surfaces on the connector mount, wherein the rear guide surfaces are sloped relative to the direction such that the TPA handle is moved relative to the TPA stop when the terminal position assurance is moved to the locked position.

17. The assembly of claim 16, wherein the terminal position assurance mount includes a plurality of lock pockets, wherein each of the rear lock tabs is located in a lock pocket when the terminal position assurance is in the locked position, and wherein the rear lock tabs engage the respective lock pocket to prevent the terminal position assurance from moving from the locked position opposite the x-direction relative to the terminal position assurance mount.

18. An assembly comprising:

a connector mount including a cavity configured to receive a terminal and a rocker attached to the connector mount; and a terminal position assurance supported on the connector mount for movement between a pre-lock position and a locked position; wherein at least a portion of the rocker is configured move relative to the connector mount from a non-biased to a biased position;

the rocker is configured to prevent the terminal position assurance from moving from the pre-lock position to the locked position when the rocker is in the non-biased position; and the rocker includes a stop arm and a cavity arm, and the cavity arm is configured to engage the terminal in the cavity to move the rocker from the non-biased to the biased position.

19. An electrical connector assembly comprising:

a connector mount including a cavity and a rocker connected to the connector mount proximate the cavity;

a terminal located in a mounted position in the cavity; and a terminal position assurance supported on the connector mount and movable relative to the connector mount between a pre-lock position and a locked position; wherein the rocker is configured to limit movement of the terminal position assurance when the rocker is in a non-biased position; and the rocker includes a stop arm that extends toward the terminal position assurance and a cavity arm that extends into the cavity.

* * * * *